US005165849A

United States Patent [19]

Nakagawa et al.

[11] Patent Number: 5,165,849

[45] Date of Patent: Nov. 24, 1992

[54] CENTRIFUGAL COMPRESSOR

[75] Inventors: Koji Nakagawa, Kashiwa; Junichi Kaneko, Ibaraki, both of Japan

[73] Assignee: Hitachi, Ltd., Tokyo, Japan

[21] Appl. No.: 755,055

[22] Filed: Sep. 5, 1991

[30] Foreign Application Priority Data

Sep. 5, 1990 [JP] Japan ..... 2-233264

[51] Int. Cl.[5] ..... F01D 1/02

[52] U.S. Cl. ..... 415/208.1; 415/148; 415/161; 415/165

[58] Field of Search ..... 415/148, 150, 155, 158, 415/161, 165, 914, 915; 416/203

[56] References Cited

U.S. PATENT DOCUMENTS

| | | | |
|---|---|---|---|
| 2,967,013 | 1/1961 | Dallenbach | 415/208.3 |
| 4,054,398 | 10/1977 | Penny | 415/161 |
| 4,877,370 | 10/1989 | Nakagawa et al. | 415/148 |
| 4,902,200 | 2/1990 | Bandukwalla | 415/148 |

FOREIGN PATENT DOCUMENTS

| | | | |
|---|---|---|---|
| 603808 | 8/1960 | Canada | 416/500 |
| 916604 | 8/1954 | Fed. Rep. of Germany . | |
| 899637 | 6/1945 | France | 415/195 |
| 973611 | 4/1951 | France | 415/195 |
| 469806 | 3/1952 | Italy | 415/195 |
| 523197 | 10/1973 | U.S.S.R. | 416/203 |

*Primary Examiner*—Edward K. Look
*Assistant Examiner*—Therese M. Newholm
*Attorney, Agent, or Firm*—Antonelli, Terry, Stout & Kraus

[57] ABSTRACT

A centrifugal compressor including a vaned diffuser provided with a plurality of stationary vanes disposed around an impeller for converting into kinetic energy of a discharged fluid into pressure. The diffuser further includes rotatable vanes unevenly distributed in the stationary vanes.

16 Claims, 13 Drawing Sheets

CENTRIFUGAL COMPRESSOR

BACKGROUND OF THE INVENTION

1. Field of the Invention

The present invention relates to a centrifugal compressor with a vaned diffuser.

2. Description of the Prior Art

Japanese Unexamined Patent Publication No. 57-159998 discloses a centrifugal compressor with its operable range broadened by small rotatable vanes at the inlets of a vaned diffuser. Japanese Unexamined Patent Publication No. 58-124099 discloses another design for broadening the operable range of a centrifugal compressor wherein a vaned diffuser comprises a pair of circular rows of vanes with the inner row of vanes movable in a direction parallel to the rotation axis of the impeller.

However, the centrifugal compressor of the Japanese 57-15998 requires a rather complex and highly accurate mechanism since the compressor must be provided with small rotatable vanes as many as the diffuser stationary vanes. The compressor of the Japanese 58-124099 requires large-sized movable parts in order to provide the parallel-movement mechanism, although the mechanism can be simpler than that of Japanese 57-159998.

SUMMARY OF THE INVENTION

An object of this invention is to provide a centrifugal compressor including a vaned diffuser having a broadened operable range achieved by a minimal mechanism.

A centrifugal compressor according to the present invention a vaned diffuser provided with a plurality of stationary vanes disposed around an impeller to convert the kinetic energy of a fluid discharged from said impeller into pressure, wherein the diffuser includes rotatable vanes which are unevenly distributed between the other vanes.

In accordance with further features of the present invention, some of the plurality of the stationary vanes are arranged such that the leading edges thereof are positioned radially outwardly of those of the other stationary vane, and such stationary vanes are unevenly distributed between the other vanes.

According to the present invention, the plurality of the stationary vanes are arranged such that the intervals of some of the stationary vanes are larger than the intervals of the other vanes and the vanes are unevenly distributed.

In accordance with still further features of the present invention, the plurality of the stationary vanes are arranged such that the intervals of some of the stationary vanes are larger than the intervals of the other vanes and the intervals of vanes adjacent the large interval vanes are smaller than those of other vanes and such sets of the larger and smaller interval vanes are unevenly distributed.

According to the present invention, some of the plurality of the stationary vanes are arranged such that the angles thereof to the radial directions of the impeller are greater or smaller than those of the other stationary vanes, with the stationary vanes being unevenly distributed.

The operable range of a centrifugal compressor with a vaned diffuser is mostly determined by the characteristic of the vaned diffuser. The lower limit of the operable range is determined by the stalling point of the vaned diffuser, while the upper limit is determined by the choking point thereof. The lower and upper limits are greatly dependent on the cross-sectional areas of the passages in the diffuser. Thus, the passages have been modified to be able to change the cross-sectional areas, e.g., the diffuser's stationary vanes are designed to be rotatable. An important factor is the total cross-sectional area of all the passages, not an individual one, since, generally, the flows through a vaned diffuser are distributed unevenly in the circumferential direction even if the stationary vanes and the passages are uniformly designed. Therefore, the operable range of the vaned diffuser can be broadened by modifying a few, not necessarily all, stationary vanes or small vanes at the entrances of the passages to rotatable vanes to adjust the total of the passage areas.

Aerodynamically, the lower limit of the operable range of a vaned diffuser means a point where the flows through all the passages begin to stall. At a point where the flows are greater than those at the lower limit, stall occurs in a few passages and the stalled areas then propagate in the direction of the circumference. This phenomena is called rotating stall and causes terrible noises and vibration. Therefore, the point where the rotating stall occurs is a practical lower limit. Therefore, the practical lower limit of the operable range also can be lowered by preventing the rotating stall as well as by the above-described method that delays the stall occurrence in all the passages.

For an effective prevention of the rotating stall, some passages may be designed so that the stall occurs therein earlier than in other passages. When the flow stalls in those passages, the flow through those passages is less than the flow through the other passages, and thus the flow through the other passages increases correspondingly, so that an occurrence of a stall is unlikely.

In order to cause an earlier stall in particular passages, some of the stationary vanes are arranged such that the leading edges thereof are positioned outwardly of those of the other stationary vanes, thereby providing wider entrances between the leading edges of the vanes. Due to the wider entrances, the load on those vanes increases, making the stall likely to occur. Also, the outwardly positioned leading edges cause the boundary layers on the side walls to become thicker than those at the leading edges of the other vanes, so that the thicker boundary layers more easily separate the flow from the vane surfaces.

Another effective way to cause the stall to occur earlier in particular passages is to arrange the stationary vanes such that some of the passages between the vanes are wider than the other passages. A wider passage causes a larger load on an adjacent vane, thereby more easily separating the flow easily from the vane surface. Further, passages narrower than the others may be provided next to the wider passages, to enhance the prevention of the rotating stall. A narrower passage causes a smaller load on an adjacent vane, thereby resulting in making the flow separation from the vane surface more difficult.

Additionally, it is also possible in accordance with the present invention is to position some of the stationary vanes angled closer to or remote from the radial directions of an associated impeller than the other stationary vanes. When a stationary vane is angled closer to the radial direction of the impeller, the flow easily separates form the side (negative pressure side) thereof following the rotational direction of the impeller. Thus, a stall occurs earlier in the passage adjacent the side of the vane than in other passages. The leading edge of the vane may be positioned outwardly of those of other vanes in order to achieve an earlier occurrence of stall for the reason stated above. When a vane is angled further away from the impeller radial direction, the passage adjacent to the side (high pressure side) of the vane opposing the rotational direction of the impeller experiences the stall earlier since the divergent angle of the passage is greater than that of each of the others. The prevention of the rotating stall is enhanced by the passage adjacent to the negative pressure side of the vane which experiences the stall later than the others since the divergent angle of the passage is smaller than that of the others. Also, the leading edge of a vane may be positioned not outwardly of those of other vanes to achieve a still later stall-occurence in the passages adjacent to the negative pressure side of the vane, by the effect opposite to the one caused by the outwardly positioned leading edges.

BRIEF DESCRIPTION OF THE DRAWINGS

FIGS. 17 to 21 illustrate still other embodiments, wherein FIGS. 17 and 19 are views of the embodiments taken in the axial directions of the impellers and the vaned diffusers and FIGS. 18, 20 and 21 are enlarged views of some of the vanes of the diffusers.

DESCRIPTION OF THE PREFERRED EMBODIMENTS

Figure 1:
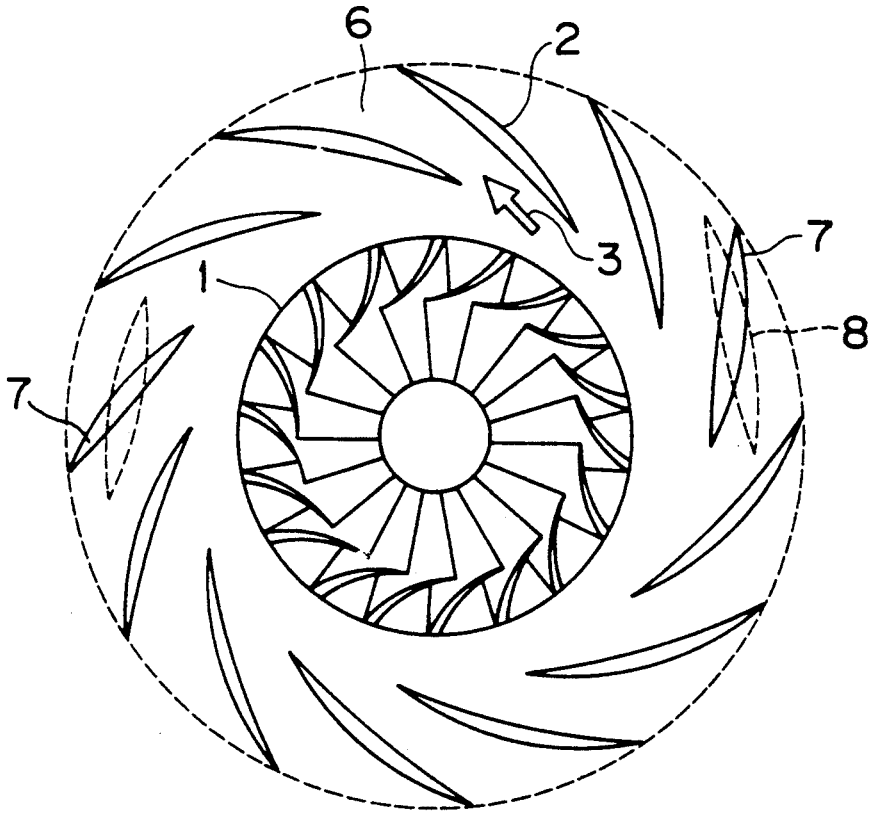
FIG. 1 is an end view of an impeller and a vaned diffuser of a first embodiment of the present invention, taken along a line I—I in FIG. 2.
Figure 2:
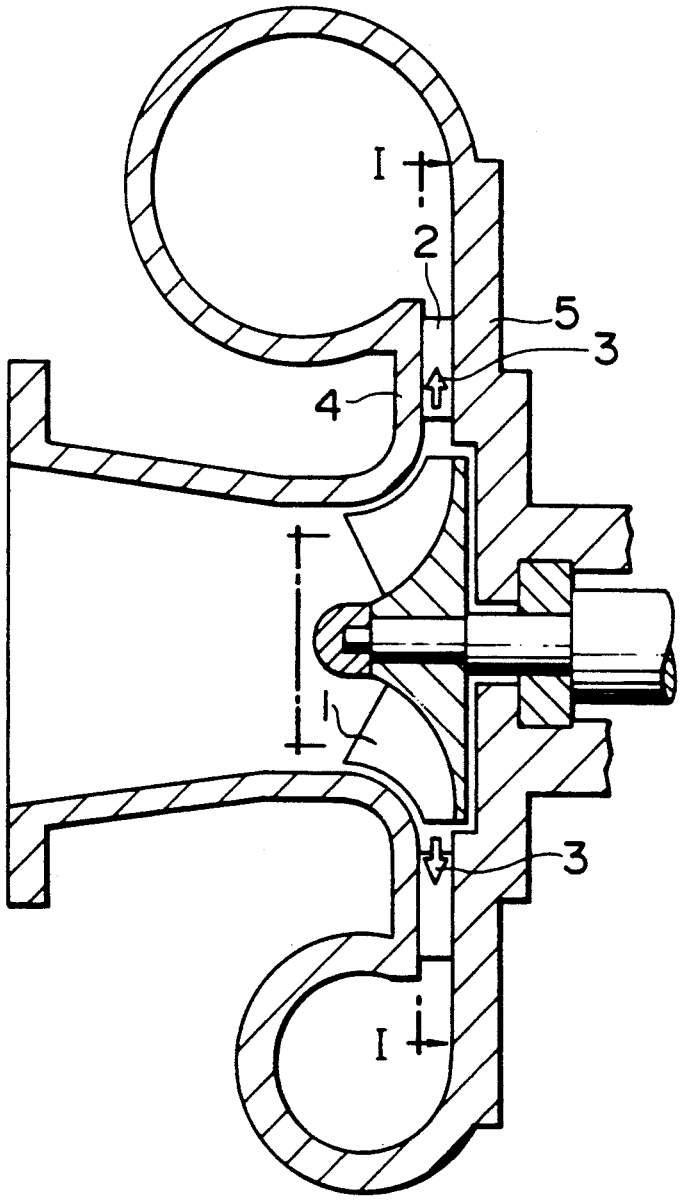
FIG. 2 is a sectional view of the embodiment of the present invention taken in a plane including the axis of the shaft of the impeller.

With reference to FIGS. 1 and 2, a plurality of fixed vanes 2, arranged around an impeller l, cooperate with a side plate 4 and a central plate 5 to define passages 6 for fluid 3 to which kinetic energy is imparted by the impeller 1. A part of the kinetic energy of the fluid 3 is converted into pressure when the fluid 3 passes through the passages 6. Adjustable vanes 7 are fixed to rotatable shafts 8 so as to be adjusted to the most suitable angle according to an operation condition of the compressor. Two adjustable vanes 7 are provided at diametrically opposed positions since when a non-axial symmetry of the flow becomes a substantial level, a considerably great radial composite force acts on the impeller 1.

Figure 3:
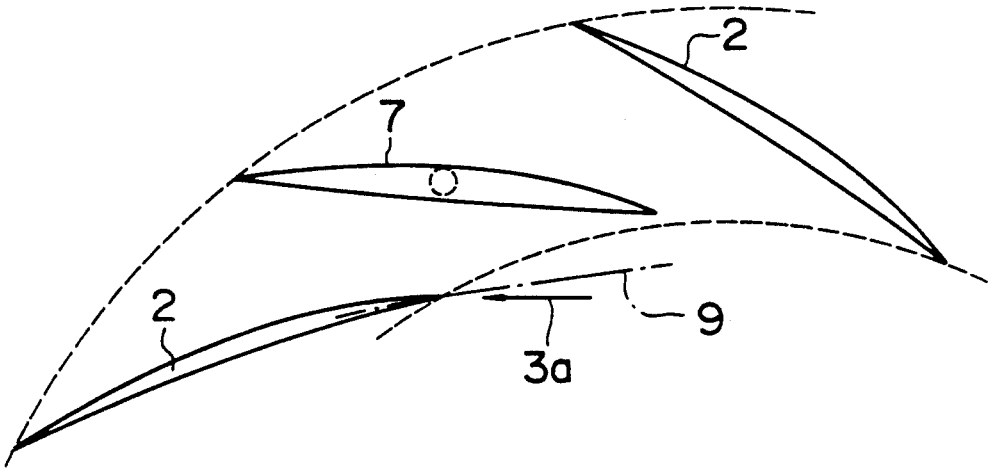
FIGS. 3 and 4 illustrate the operations of the embodiment shown in FIGS. 1 and 2.
Figure 4:
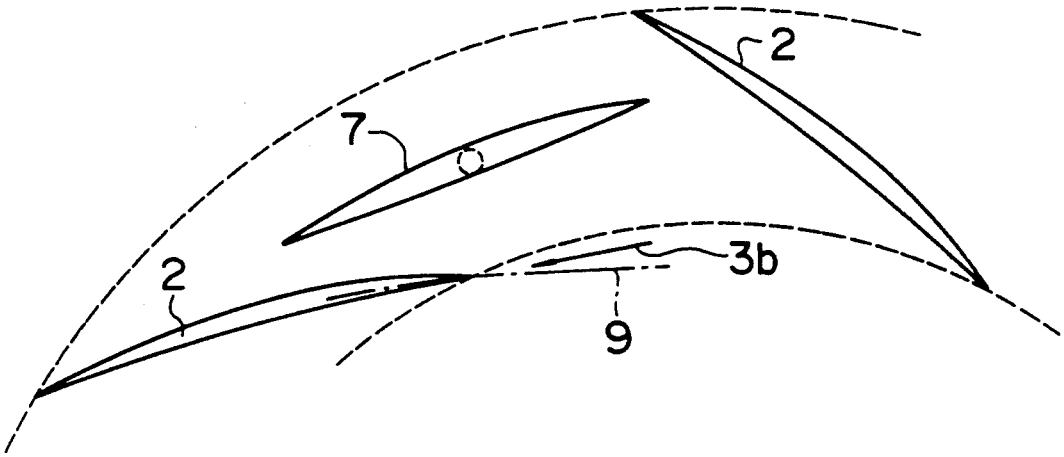

With reference to FIGS. 3 and 4, the operation of the compressor of the present invention will be described. When the flow rate is substantially as much as the design value or more, the fluid flow from the impeller 1 goes towards each fixed vane 2 in the direction of a camber line 9 of the fixed vane 2 or in a direction shifted clockwise from the camber line 9 toward a radial line, as indicated by an arrow 3*a*. In this condition, the adjustable vanes 7 are each rotated to an angle shown in FIG. 3 to provide wider passages between the diffuser fixed vanes so as to prevent the performance from being lowered by choking. When the flow rate is less than the design value, the fluid flow goes towards each fixed vane 2 in a direction shifted counterclockwise from the camber line 9, as indicated by an arrow 3*b*. In this condition, the adjustable vanes 7 are each set to an angle shown in FIG. 4 to narrow the passages between the diffuser fixed vanes. The total of the cross-sectional areas of the passages 6 is reduced in this way and causes the fluid flow to the fixed vanes 2 to be shifted from the direction 3*b* towards the direction 3*a*, thereby to prevent the occurrence of stalling. Thus, the lower limit of the operable range can be lowered.

Figure 5:
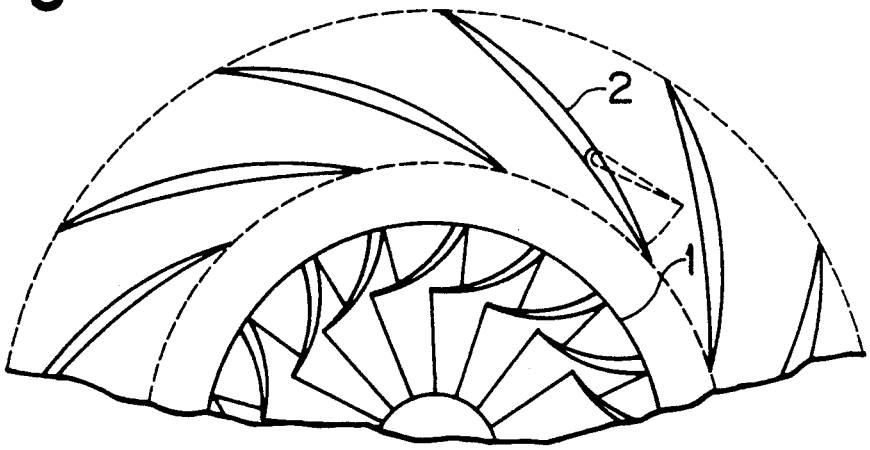
FIGS. 5 to 7 illustrate modifications of the first embodiment.
Figure 6:
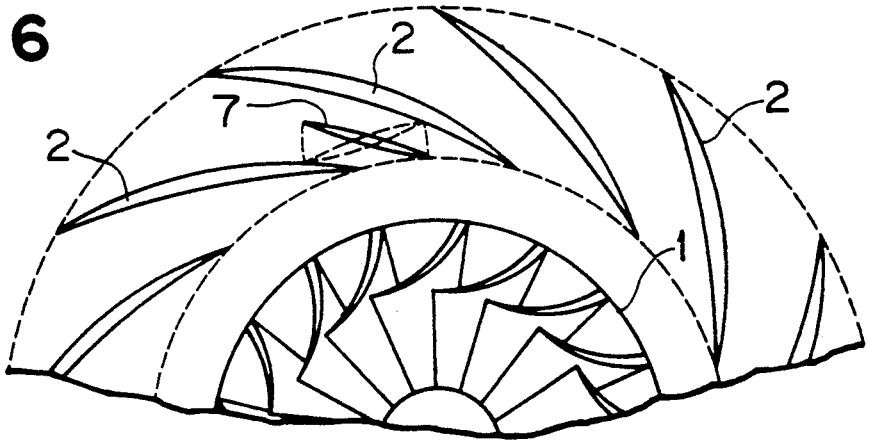
Figure 7:
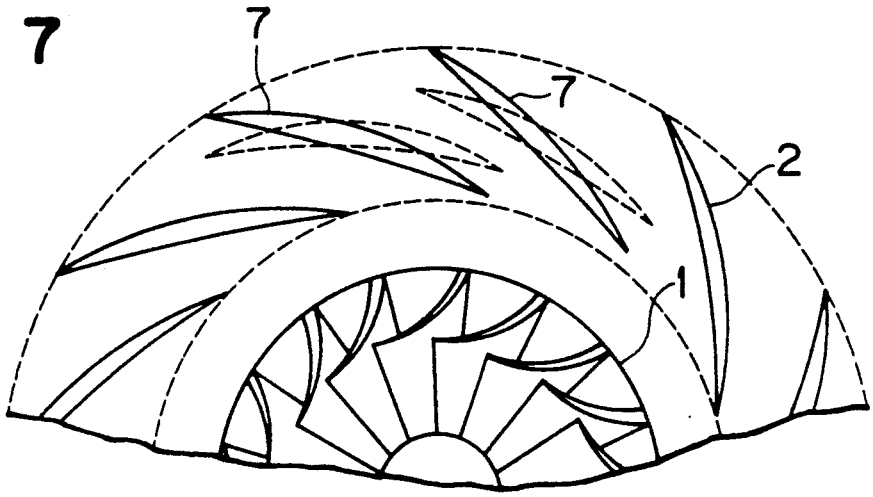

Various modifications to the adjustable vanes are illustrated in FIGS. 5 to 7. In FIG. 5, an entrance portion of a fixed vane is pivotable. In FIG. 6, an adjustable vane 7 is provided at an entrance portion of a passage between adjacent fixed vanes 2. In FIG. 7, adjustable vanes 7 are disposed in adjacent relationship to each other. The embodiments shown in FIGS. 5 and 6 have an advantage that the adjustable vanes 7 can be formed in small-dimensions, while the embodiment shown in FIG. 7 offers a broader adjustment for the cross-sectional area of the passage between the diffuser vanes 2.

In the embodiments show in FIGS. 8 to 15, a small number of the passages between the vanes are formed so that the flow therethrough stalls earlier than in other passages. In this way, the propagation of stalled passages is suppressed to prevent the occurrence of a rotating stall.

Figure 8:
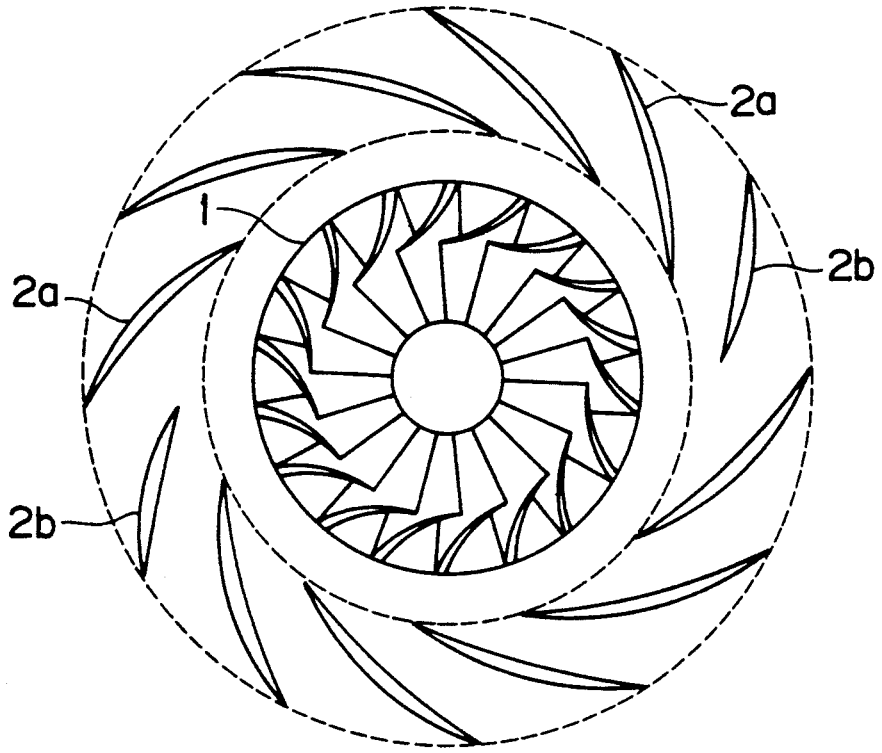
FIGS. 8 to 16 illustrate embodiments comprising mechanisms to prevent the propagation of stalled areas.
Figure 9:
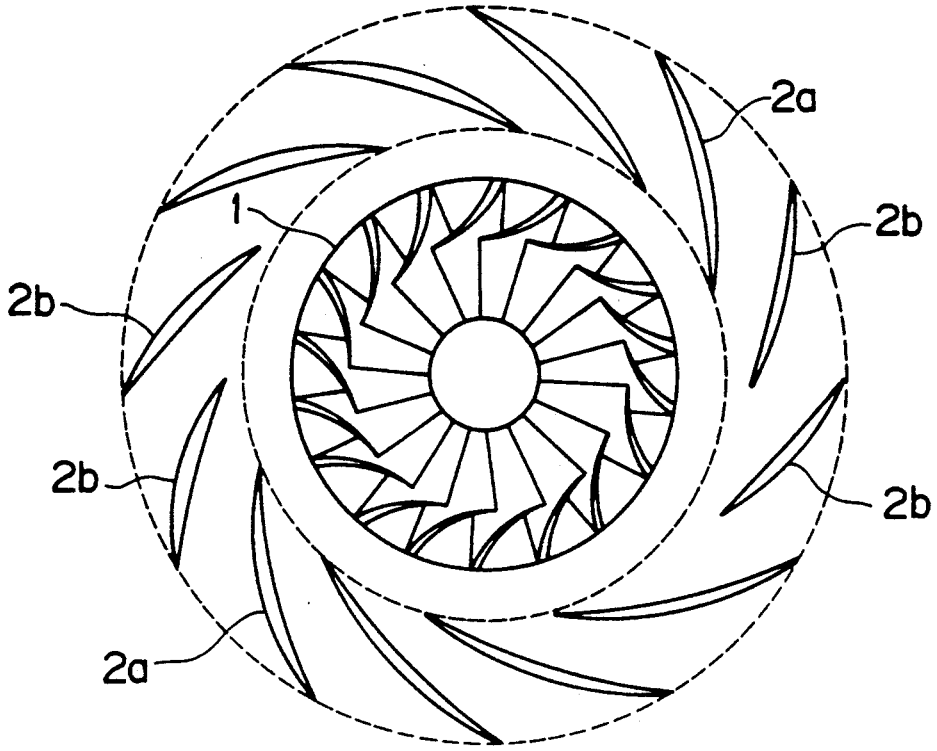

In the embodiments shown in FIGS. 8 and 9, fixed vanes 2*b* are provided so that the leading edges thereof are positioned outwardly of those of the other fixed vanes 2*a* in order that the stall occurs earlier at the passages adjacent to the fixed vanes 2*b* than at the other passages. In the embodiment of FIG. 9, the fixed vanes 2*b* are disposed in adjacent relationship to each other for more effective prevention of the rotating stall.

Figure 10:
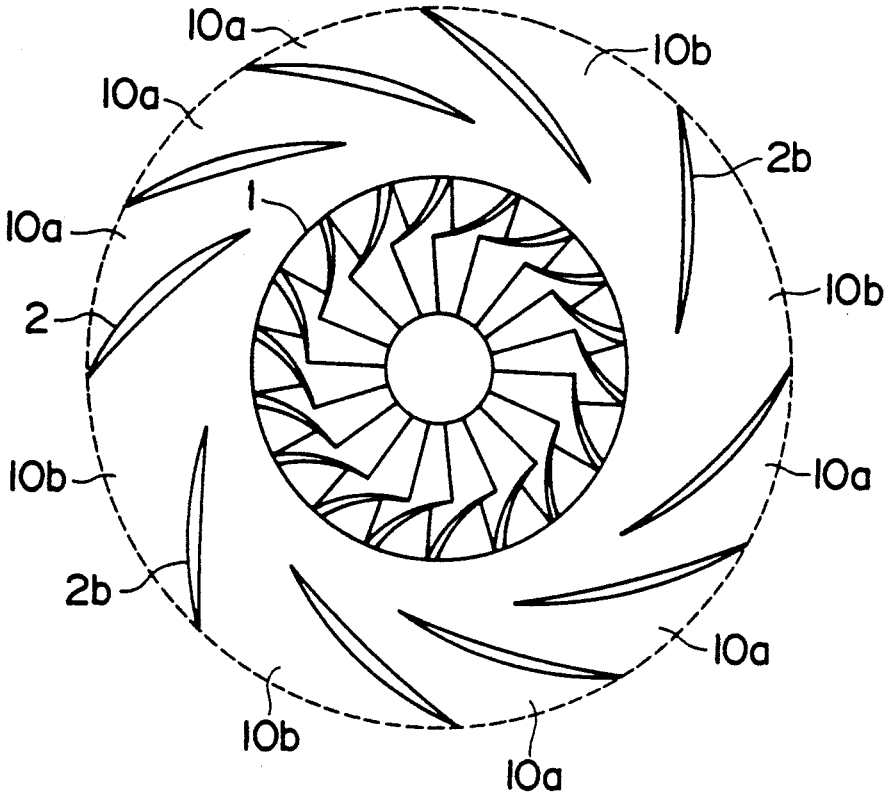

The embodiment shown in FIG. 10 includes a few fixed vanes 2*b* which are disposed such so that the passages 10*b* between these vanes are wider than the passages 10*a* between other vanes 2. The passages 10*b* experience the stall earlier than the other passages 10*a*.

Figure 11:
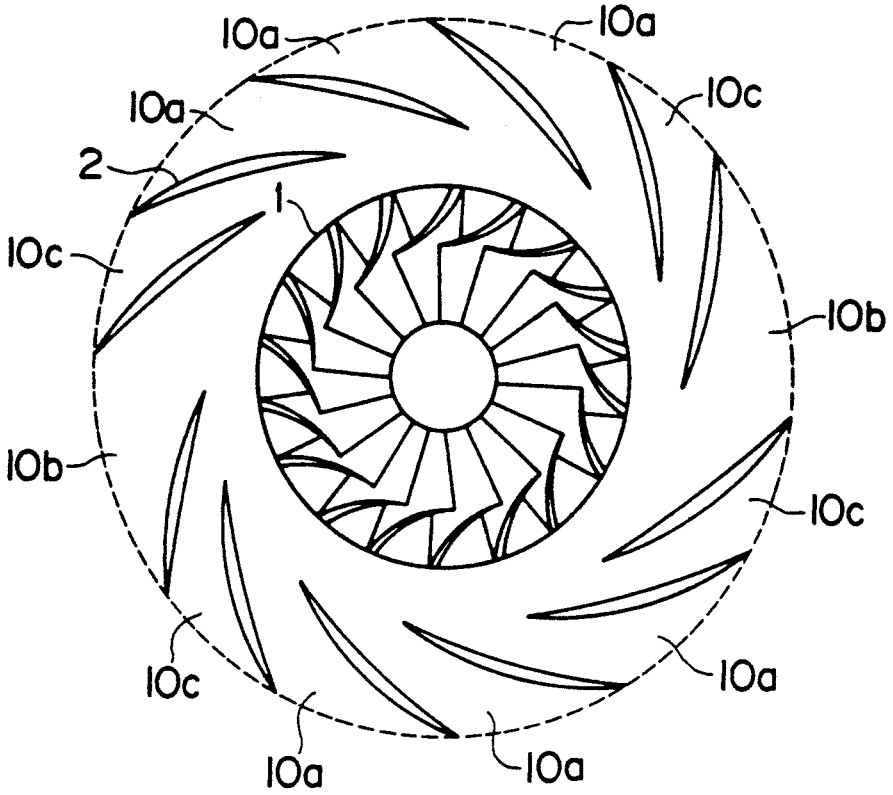

In the embodiment shown in FIG. 11, passages 10*c* narrower than the passages 10*a* are provided on both sides of wider passages 10*b* for more effective prevention of the propagation of stalled areas and thus of the rotation stall.

Figure 12:
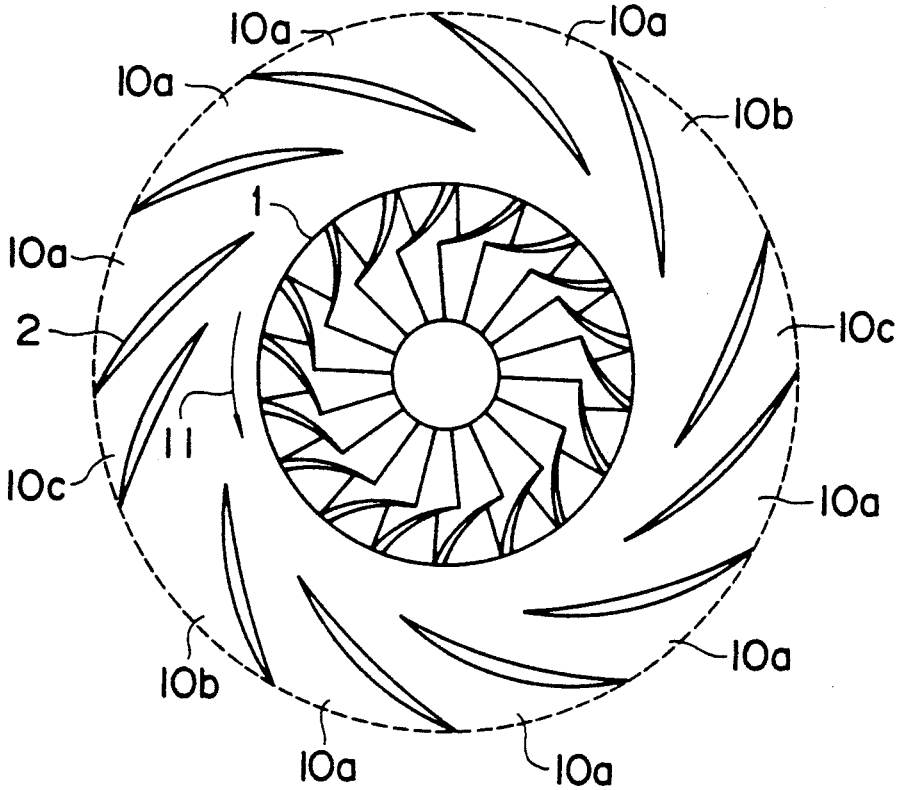

The embodiment shown in FIG. 12 has a narrower passage 10*c* disposed only at the back side of a wider passage 10*b* as viewed in the rotational direction 11 of the impeller 1.

Figure 13:
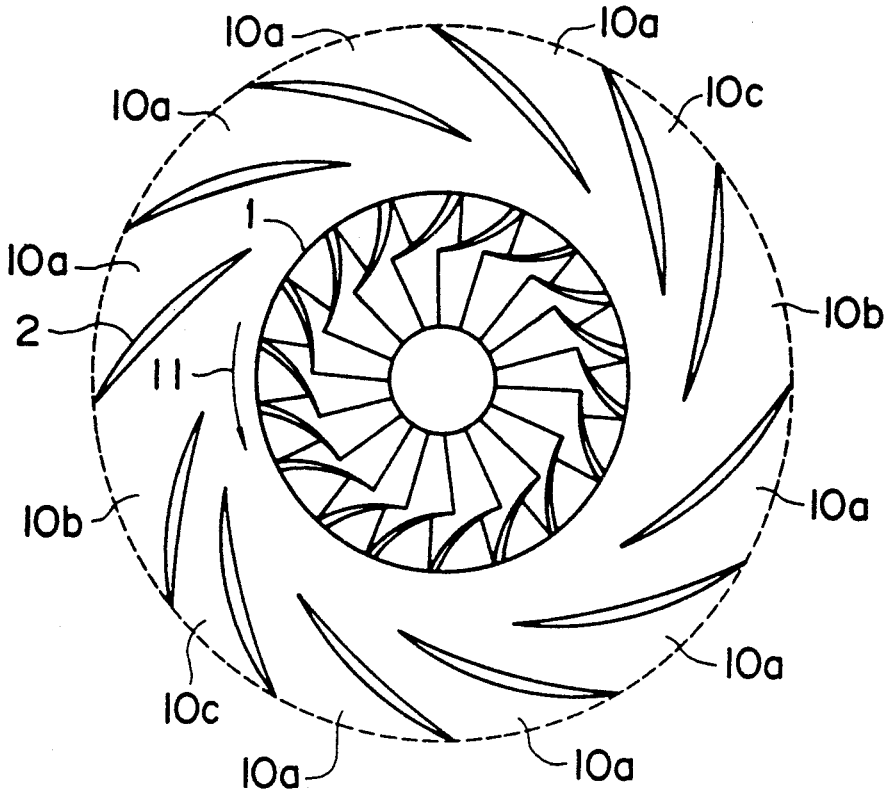

The embodiment in FIG. 13 has a narrower passage 10*c* only at the front side of a wider passage 10*b*.

Figure 14:
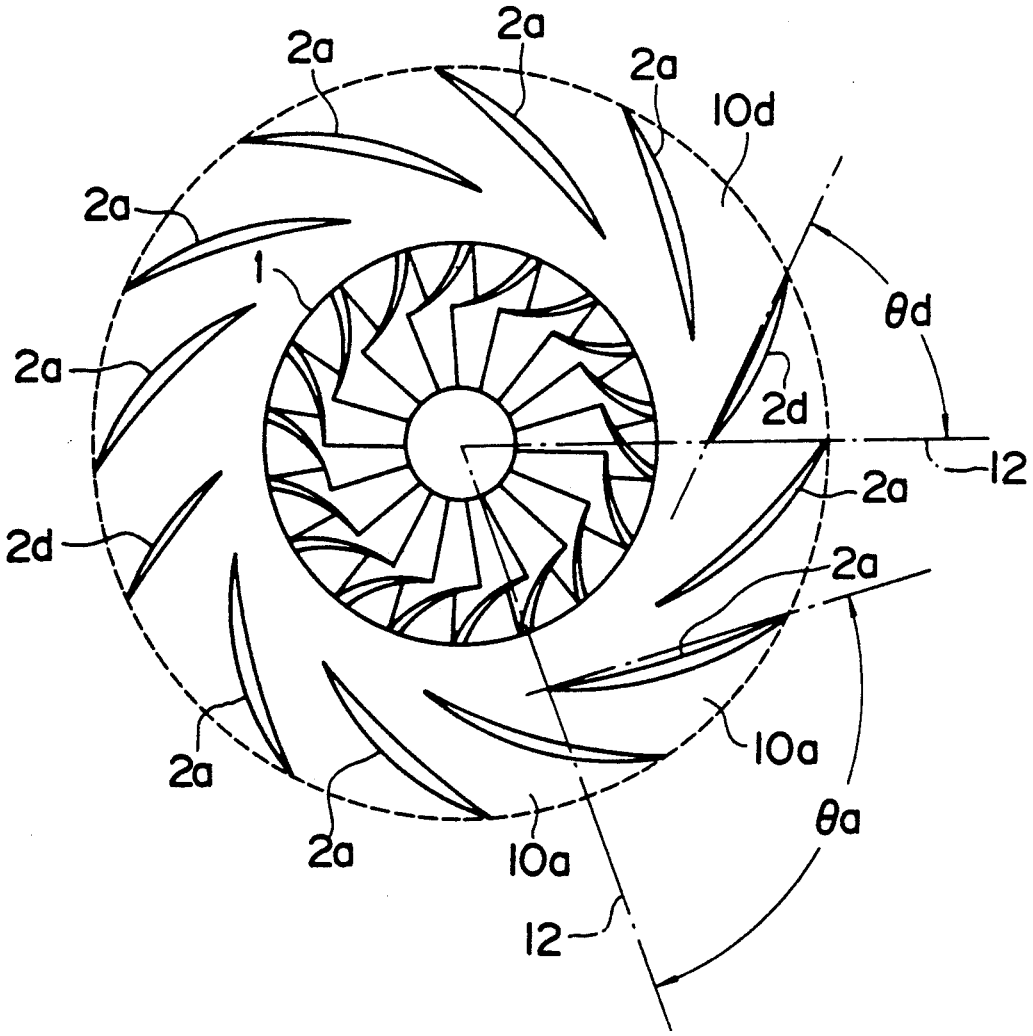

The embodiment shown in FIG. 14 has a small number of fixed vanes 2*d* rotated towards the radial direction 12 of the impeller 1 so that an angle $\theta d$ between each fixed vane 2*d* and the radial direction 12 is smaller than a corresponding angle $\theta a$ of each of the other fixed vanes 2*a*. The stall occurs earlier in a passage 10*d* adjacent to the negative-pressure surface of each fixed vane 2*d* than in the other passages 10*a*.

Figure 15:
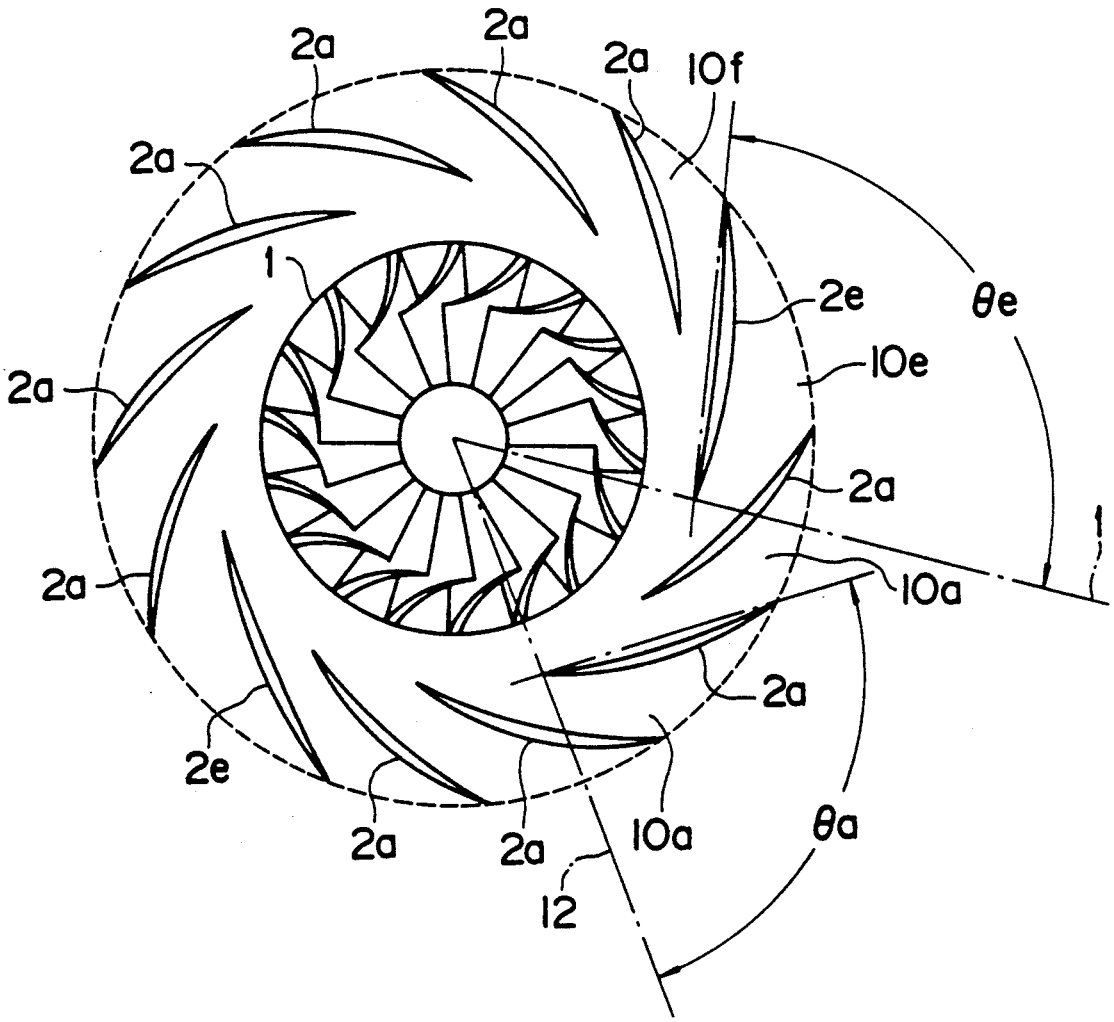

The embodiment shown in FIG. 15 has a small number of fixed vanes 2*e* rotated away from the radial direction 12 so that an angle $\theta e$ is larger than the angle $\theta a$. The flow stalls earlier in a passage 10*e* adjacent to the positive-pressure surface of each fixed vane 2*e* than in the other passages 10*a*.

Figure 16:
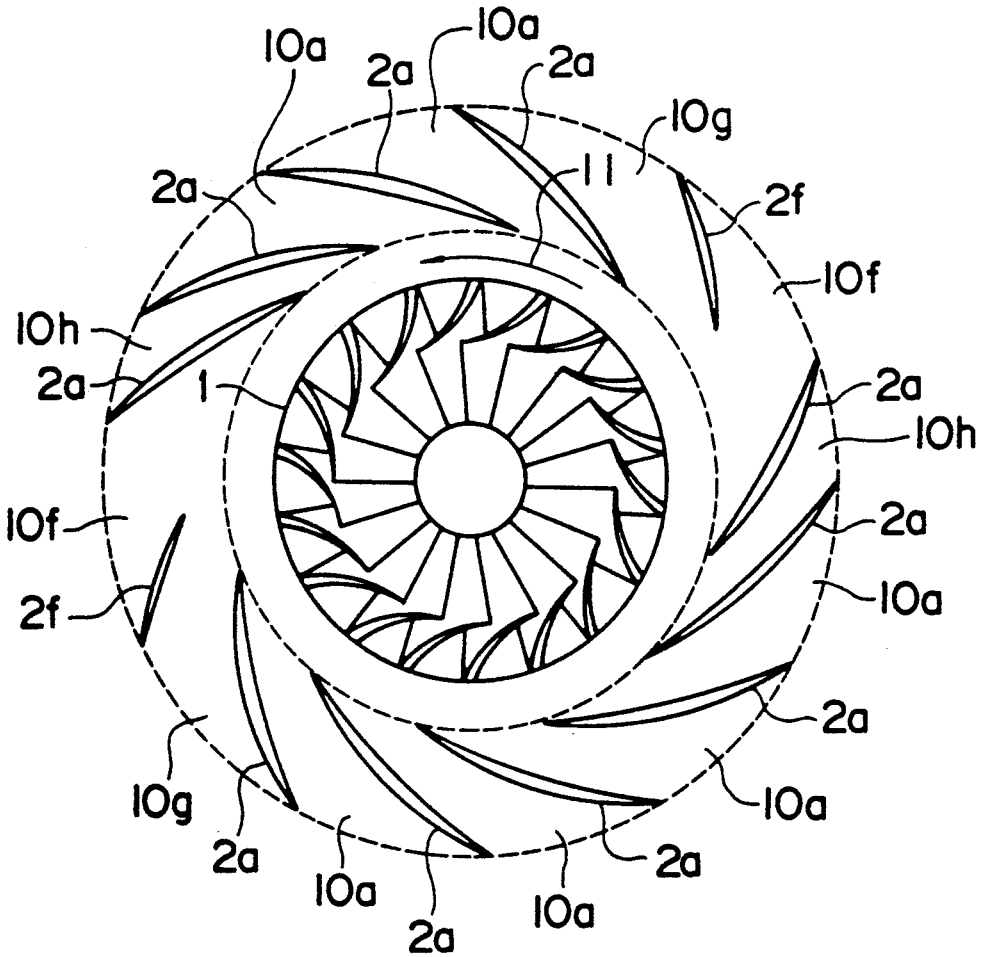

In the embodiment illustrated in FIG. 16, fixed vanes 2*f* are provided so that the leading edges thereof are positioned outwardly of those of the other fixed vanes 2a and passages 10f and 10g adjacent to each vane 2f are each wider than each of the other passages 10a. Further, a passage 10h narrower, than each of the other passages 10a, is disposed on the back side of a passage 10g as viewed in the rotational direction 11 of the impeller 1. This embodiment has both of the advantages provided by the embodiments shown in FIGS. 8 and 12 with respect of the prevention of the stalled-area propagation.

Figure 17:
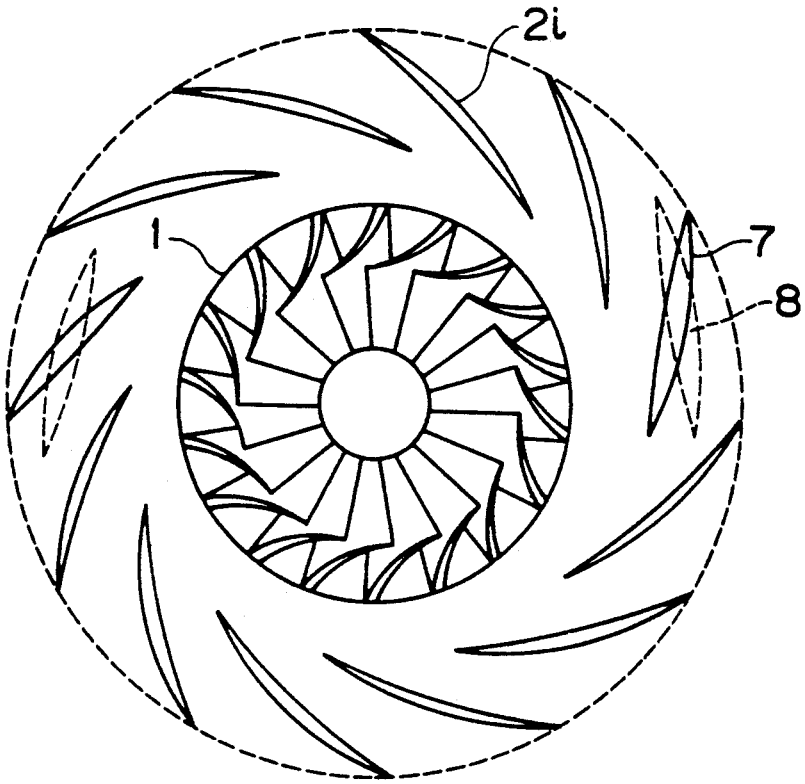
Figure 18:
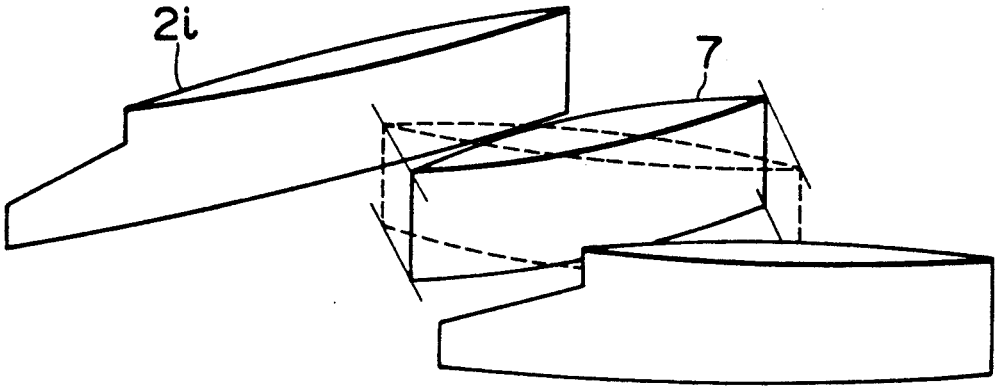

The embodiment shown in FIGS. 17 and 18 has fixed vanes 2i provided with leading edges having different radial positions adjacent the side plate and the central plate in order to broaden operable range at its lower limit. This embodiment also includes adjustable vanes 7. The fixed vanes 2i, highly effective to lower the lower limit of the operable flow range, are combined with the adjustable vanes 7 in order to achieve a still lower limit of the operable range.

Figure 19:
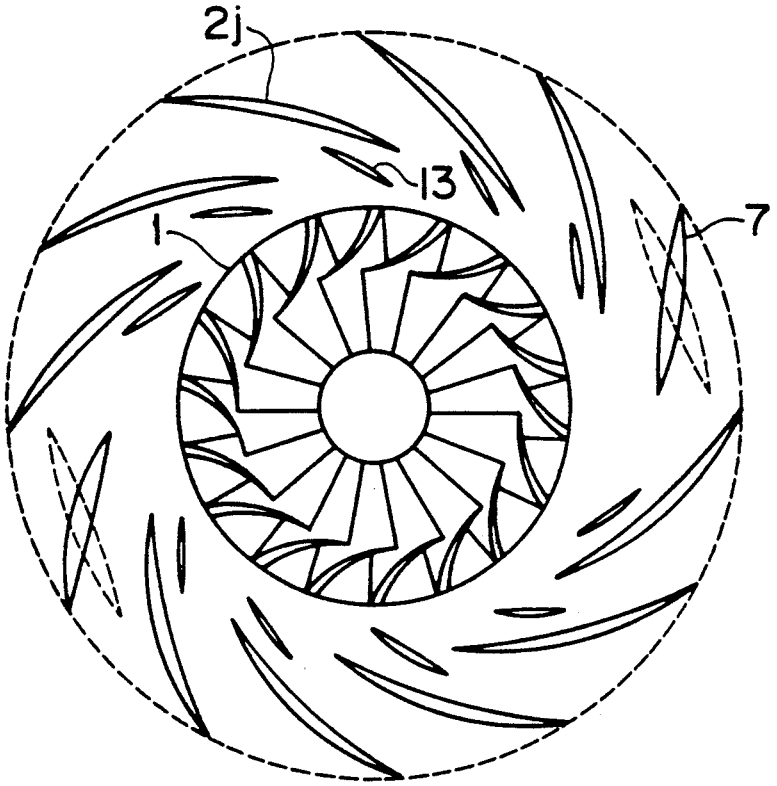
Figure 20:
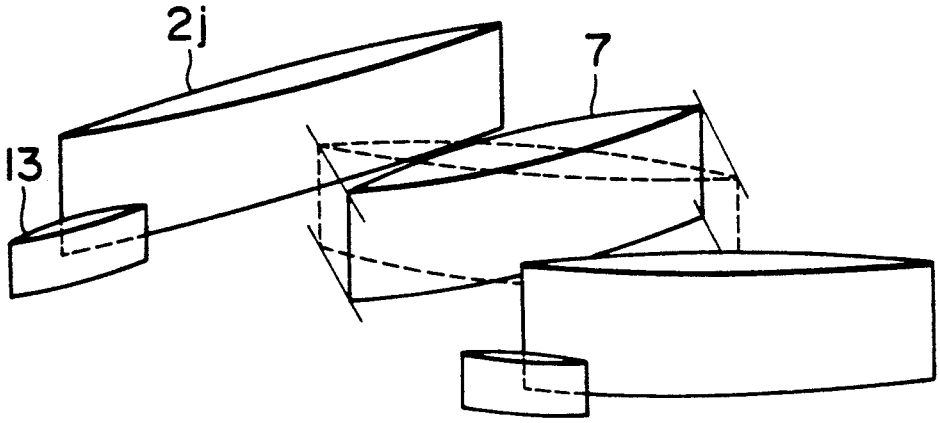
Figure 21:
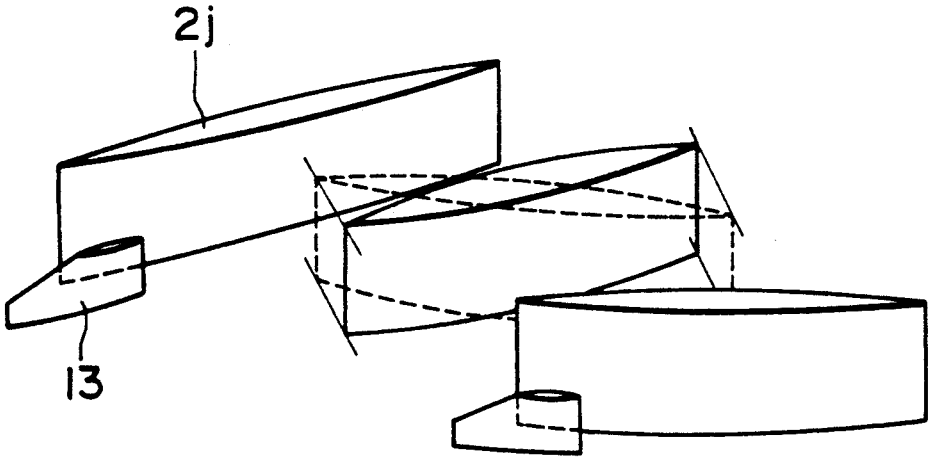

For lowering the lower limit of the operable range, the embodiments shown in FIGS. 19 to 21 has fixed vanes 2j and auxiliary vanes 13 each having a cord length smaller than that of each fixed vane 2j and a height equal to or less than that of the fixed vane 2j, as well as adjustable vanes 7. Each auxiliary vane 13 is disposed inwardly of the leading edges of the fixed vanes 2j so that only one side of each auxiliary vane 13 faces a fixed vane 2j. The auxiliary vanes 13 may have the leading edges sloped as shown in FIG. 21 to reduce the noise and increase the strength. In the embodiments in FIGS. 19 to 21, the combination of the fixed vanes 2j and the auxiliary vanes 13, highly effective to lower the lower limit of the operable range, is employed in further combination with the adjustable vanes 7 in order to still further lower the lower limit of the operable range.

What is claimed is:

1. A centrifugal compressor comprising an impeller and a vaned diffuser provided with a plurality of stationary vanes disposed around said impeller and operative to convert the kinetic energy of a fluid discharged from said impeller into pressure, wherein said diffuser is further provided with rotatable vanes which are unevenly distributed in said stationary vanes.

2. A centrifugal compressor as defined in claim 1, wherein some of said plurality of stationary vanes are provided with leading edges which are sloped so that said some of said plurality of stationary vanes have portions adjacent to a side plate and a central plate of the compressor and are unevenly distributed, said portions being offset radially of said impeller.

3. A centrifugal compressor as defined in claim 1, further comprising auxiliary vanes each having a chord length less than a chord length of each of said stationary vanes and a height equal to or less than a height of each of said stationary vanes, wherein said auxiliary vanes are unevenly distributed in said stationary vanes, and wherein said auxiliary vanes are disposed adjacent to leading edges of associated stationary vanes such that only one side of each auxiliary vane faces the associated stationary vane.

4. A centrifugal compressor as defined in claim 1, further comprising auxiliary vanes each having chord length less than a chord length of each of said stationary vanes and a height equal to or less than a height of each of said stationary vanes, wherein said auxiliary vanes are unevenly distributed in said stationary vanes, each of said auxiliary vanes is disposed adjacent to a leading edge of an associated stationary vane such that the auxiliary vane has only one side thereof facing the associated stationary vane, and wherein each auxiliary vane has a leading edge sloped from the side thereof adjacent to a side plate of the compressor to the side thereof adjacent to a central plate of the compressor.

5. A centrifugal compressor comprising an impeller and a vaned diffuser provided with a plurality of stationary vanes disposed around said impeller and operative to convert the kinetic energy of a fluid discharged from said impeller into pressure, wherein some of said plurality of stationary vanes have leading edges thereof positioned outwardly of those of the other vanes and are unevenly distributed in said other vanes, and wherein some of said plurality of stationary vanes are provided with leading edges which are sloped so that said some of said plurality of stationary vanes have portions adjacent to a side plate and a central plate of the compressor and are unevenly distributed, said portions being offset radially of said impeller.

6. A centrifugal compressor comprising an impeller and a vaned diffuser provided with a plurality of stationary vanes disposed around said impeller and operative to convert kinetic energy of a fluid discharged from said impeller into pressure, wherein said plurality of stationary vanes are arranged at such that some of said stationary vanes are arranged at intervals larger than intervals of the other vanes and are unevenly distributed, and wherein some of said plurality of stationary vanes are provided with leading edges which are sloped so that some of said plurality of stationary vanes have portions adjacent to a side plate and a central plate of the compressor and are unevenly distributed, said portions being offset radially of said impeller.

7. A centrifugal compressor comprising an impeller and a vaned diffuser provided with a plurality of stationary vanes disposed around said impeller and operative to convert kinetic energy of a fluid discharged from said impeller into pressure, wherein said plurality of stationary vanes are arranged such that some of said stationary vanes are arranged at intervals larger than intervals of the other vanes, the vanes located adjacent to the larger-interval vanes are arranged at intervals less than those of other vanes and are unevenly distributed, and wherein some of said plurality of stationary vanes are provided with leading edges which are sloped so that said some of said plurality of stationary vanes have portions adjacent to a side plate and a central plate of the compressor and are unevenly distributed, said portions being offset radially of said impeller.

8. A centrifugal compressor comprising an impeller in a vaned diffuser provided with a plurality of stationary vanes disposed around said impeller to convert kinetic energy of a fluid discharged from said impeller into pressure, wherein some of said plurality of stationary vanes are positioned so that angles thereof to a radial direction of said impeller are greater or less than angles of the other stationary vanes and said some of said plurality of stationary vanes are unevenly distributed, and wherein said some of said plurality of stationary vanes are provided with leading edges which are sloped so that said some of said plurality of stationary vanes have portions adjacent to a side plate in a central plate of the compressor and are unevenly distributed, said portions being offset radially of said impeller.

9. A centrifugal compressor comprising an impeller in a vaned diffuser provided with a plurality of stationary vanes disposed around said impeller and operative to convert kinetic energy of a fluid discharged from said impeller into pressure, wherein some of said plurality of stationary vanes have leading edges thereof positioned outwardly of those of other vanes and are unevenly distributed in said other vanes, auxiliary vanes are provided each having a chord length smaller than a chord length of each of said stationary vanes in a height equal to or less than a height of each of said stationary vanes, said auxiliary vanes being unevenly distributed in said stationary vanes, and wherein said auxiliary vanes are disposed adjacent to leading edges of the associated stationary vanes such that only one side of each auxiliary vanes faces the associated stationary vane.

10. A centrifugal compressor comprising an impeller in a vaned diffuser provided with a plurality of stationary vanes disposed around said impeller and operative to convert kinetic energy of a fluid discharge from said impeller into pressure, wherein said plurality of stationary vanes are arranged such that some of said stationary vanes are arranged at intervals larger than intervals of other vanes and are unevenly distributed, auxiliary vanes are provided each having a chord length smaller than a chord length of each of said stationary vanes and a height equal to or less than a height of each of said stationary vanes, said auxiliary vanes being unevenly distributed in such stationary vanes, and wherein said auxiliary vanes are disposed adjacent to leading edges of associated stationary vanes such that only one side of each auxiliary vane faces the associated vane.

11. A centrifugal compressor comprising an impeller in a vaned diffuser provided with a plurality of stationary vanes disposed around said impeller and operative to convert kinetic energy of a fluid discharged from said impeller into pressure, wherein said plurality of stationary vanes are arranged such that some of said stationary vanes are arranged at intervals larger than intervals of the other vanes, the vanes located adjacent to the larger-interval vanes are arranged at intervals less than intervals of the other vanes and are unevenly distributed, auxiliary vanes are provided each having a chord length less than a chord length of each of said stationary vanes and a height equal to or less than a height of each of said stationary vanes, said auxiliary vanes being unevenly distributed in such stationary vanes, and wherein said auxiliary vanes are disposed adjacent to leading edges of associated stationary vanes such that only one side of each auxiliary vanes faces the associated stationary vane.

12. A centrifugal compressor comprising an impeller in a vaned diffuser provided with a plurality of stationary vanes disposed around said impeller to convert kinetic energy of a fluid discharged from said impeller into pressure, wherein some of said plurality of stationary vanes are positioned so that angles thereof to a radial direction of said impeller are greater or less than angles of the other stationary vanes and said some of said plurality of stationary vanes are unevenly distributed, auxiliary vanes are provided each having a chord length smaller than a chord length of each of said stationary vanes and a height equal to or less than a height of each of said stationary vanes, said auxiliary vanes being unevenly distributed in such stationary vanes, and wherein said auxiliary vanes are disposed adjacent to leading edges of associated stationary vanes such that only one side of each auxiliary vane faces the associated stationary vane.

13. A centrifugal compressor comprising an impeller in a vaned diffuser provided with a plurality of stationary vanes disposed around said impeller and operative to convert kinetic energy of a fluid discharged from said impeller into pressure, wherein some of said plurality of stationary vanes have leading edges thereof positioned outwardly of those of the other vanes and are unevenly distributed in said other vanes, auxiliary vanes are provided each having a chord length less than a chord length of each of said stationary vanes and a height equal to or less than a height of each of said stationary vanes, said auxiliary vanes being unevenly distributed in said stationary vanes, each of said auxiliary vanes is disposed adjacent to a leading edge of an associated stationary vane such that the auxiliary vane has only one side to the route facing the associated stationary vane, and wherein each auxiliary vane has a leading edge sloped from the side thereof adjacent to a side plate of the compressor to a side thereof adjacent to a central plate of the compressor.

14. A centrifugal compressor comprising an impeller and a vaned diffuser provided with a plurality of stationary vanes disposed around said impeller and operative to convert kinetic energy of a fluid discharged from said impeller into pressure, wherein said plurality of stationary vanes are arranged such that some of said stationary vanes are arranged at intervals larger than intervals of the other vanes and are unevenly distributed, auxiliary vanes are provided each having a chord length less than a chord length of each of said stationary vanes in a height equal to or less than a height of each of said stationary vanes, said auxiliary vanes being unevenly distributed in such stationary vanes, each of said auxiliary vanes is disposed adjacent to a leading edge of an associated stationary vane such that the auxiliary vane has only one side thereof facing the associated stationary vane, and wherein each auxiliary vane has a leading edge sloped from a side thereof adjacent to a side plate of the compressor to a side thereof adjacent to a central plate of the compressor.

15. A centrifugal compressor comprising an impeller in a vaned diffuser provided with a plurality of stationary vanes disposed around said impeller and operative to convert kinetic energy of a fluid discharged from said impeller into pressure, wherein some said plurality of stationary vanes are arranged such that some of said stationary vanes are arranged at intervals larger than intervals of the other vanes, the vanes located adjacent to the larger-interval vanes are arranged at intervals less than the intervals of the other vanes and are unevenly distributed, auxiliary vanes are provided each having a chord length less than a chord length of each of said stationary vanes in a height equal to or less than a height of each of the stationary vanes, said auxiliary vanes being unevenly distributed in such stationary vanes, each of said auxiliary vanes is disposed adjacent to a leading edge of an associated stationary vane such that the auxiliary vane has only one side thereof facing the associated stationary vane, and wherein each auxiliary vane has a leading edge sloped from a side thereof adjacent to a side plate of the compressor to a side thereof adjacent to a central plate of the compressor.

16. A centrifugal compressor comprising an impeller in a vaned diffuser provided with a plurality of stationary vanes disposed around said impeller to convert kinetic energy of a fluid discharged from said impeller into pressure, wherein some of said plurality of stationary vanes are positioned so that angles thereof to a radial direction of said impeller are greater or less than angles of the other stationary vanes and said some of said plurality of stationary vanes are unevenly distributed, auxiliary vanes are provided each of which have a chord length less than a chord length of each of said stationary vanes in a height equal to or less than a height of each of said stationary vanes, said auxiliary vanes being unevenly distributed in such stationary vanes, each of said auxiliary vanes is disposed adjacent to a leading edge of an associated stationary vane such that the auxiliary vane has only one side thereof facing the associated stationary vane, and wherein each auxiliary vane has a leading edge slope from the side thereof adjacent to a side plate of the compressor to a side thereof adjacent to a central plate to the compressor.

* * * * *